United States Patent [19]

Burnside et al.

[11] Patent Number: 4,579,563

[45] Date of Patent: Apr. 1, 1986

[54] METHOD AND APPARATUS FOR FLUIDIZING COAL TAR SLUDGE

[76] Inventors: Kenneth D. Burnside, 5050 - 82nd Ct., Crown Point, Ind. 46307; Daniel C. Deer, III, Lougeay Rd., Pittsburgh, Pa. 15235

[21] Appl. No.: 723,461

[22] Filed: Apr. 15, 1985

[51] Int. Cl.[4] ..... C10L 1/32

[52] U.S. Cl. ..... 44/51; 241/21

[58] Field of Search ..... 44/51; 241/21

[56] References Cited

U.S. PATENT DOCUMENTS 1,390,232 9/1921 Bates ..... 44/51

4,149,854 4/1979 Kohn ..... 44/51

*Primary Examiner*—Y. Harris-Smith

*Attorney, Agent, or Firm*—Mason, Kolehmainen, Rathburn & Wyss

[57] ABSTRACT

A method and apparatus fluidizes solid deposits of coal tar sludge, such as coal tar decanter sludge or coal tar tank sludge to a relatively homogeneous mixture of solids dispersed in liquid. The coal tar decanter sludge received from the coke oven, including approximately 10 to 50% by weight coal and coke solids, is conveyed into a sludge mixing vessel where it is deposited onto a liquid-permeable support member or screen having a predetermined maximum screen size. A suitable coal tar solvent in the sludge mixing vessel is heated to a temperature sufficient to partially solubilize and reduce the viscosity of the coal tar portion of the coal tar decanter sludge to provide a pumpable dispersion of solids dispersed in a diluted coal tar mixture. Agglomerates of coal and coke solids held together with coal tar fall through the screen when sufficient coal tar has solubilized and the solid agglomerates then are reduced in size for recirculation to the sludge mixing vessel. The diluted coal tar mixture is pumped to recirculate it to the sludge mixing vessel after impacting and shearing the solid agglomerates to reduce the solids particle size.

10 Claims, 4 Drawing Figures

METHOD AND APPARATUS FOR FLUIDIZING COAL TAR SLUDGE

FIELD OF THE INVENTION

The present invention is directed to an apparatus and method for treating solid deposits of coal tar sludge waste material to convert the material into a fluidized, pumpable dispersion of solids in liquid. More particularly, the present invention is directed to an apparatus and method for treating coal tar decanter sludge containing agglomerated coal and coke solid particles to provide a relatively homogeneous dispersion of solids in a diluted coal tar liquid for use as a fuel.

BACKGROUND OF THE INVENTION AND PRIOR ART

Coal is thermally pyrolized or distilled by heating without contact with air at a temperature of about 950° to 1800° F. in a coke oven to produce coke and a variety of liquid and gaseous by-products. The liquid and gaseous by-products of coke include, as liquids, water, coal tar and crude light oil and include as gaseous products hydrogen, methane, ethylene, carbon monoxide, carbon dioxide, hydrogen sulfide, ammonia, and nitrogen.

Until about the middle of the nineteenth century, the coal tar by-product of coke was regarded as a waste material but, increasingly, uses have been found for coal tar products. For example, some of the coal tars meet specifications required for roofing and road tars. Other coal tars have been reduced in viscosity by dilution with solvents and the diluted coal tars used as a fuel in open-hearth furnaces.

While others have found uses for most of the coal tar by-products from the coking oven, the coal tar sludges remain as waste products, such as coal tar tank sludge, and particularly a fraction of coal tar known as coal tar "decanter sludge". Generally, coal tar from the coking oven is first received in a coal tar decanter vessel which also receives some fine solid particles of coal and coke from the coking oven. These solid particles settle to the bottom of the coal tar decanter vessel where they agglomerate by binding with coal tar together with other solid waste materials, such as ash, into cementaciously bound solid waste products known as "tar decanter sludge". The useful liquid coal tar is decanted from the coal tar decanter vessel into a coal tar holding tank maintained heated for sufficiently low viscosity for pumping to suitable transport vessels. The coal tar holding tank also produces a sludge at the bottom of the vessel called a "tank sludge", comprising solid deposits of tar, sludge, ash and quinoline—essentially all solvent-soluble hydrocarbons.

The tar decanter sludges, on the other hand, include a substantial percentage of non-dissolvable solids, such as coal and coke, which, together with the viscous coal tar received in the coal tar decanter vessel, results in a sludge containing approximately 10 to 50% by weight solid particles of coal and coke with the remainder being very viscous, sticky coal tar and other hydrocarbon materials tending to bind adjacent coal and coke particles together into cementacious agglomerates.

The combination of coal tar and coal and coke solids (tar decanter sludge) remains today as a hazardous waste product which is very expensive to dispose of in accordance with EPA guidelines. While it is believed that others have tried to thin coal tar decanter sludges with oils and the like and others have tried to grind this solid cementacious mass for recycle to the coking ovens, no one has found a commerically viable method or apparatus capable of sufficiently reducing the particle size of the agglomerates or capable of providing a suitable solid/liquid dispersion for use as a fuel.

In accordance with the present invention, a method and apparatus has been found capable of converting coal tar decanter sludges and other coal tar sludges into useful pumpable products such as a fuel, dust suppressants for spraying coal fields, and bulk density controlling agents.

SUMMARY OF THE INVENTION

In brief, the present invention is directed to a method and apparatus for fluidizing solid deposits of coal tar sludges, and particularly coal tar decanter sludge, to a relatively homogeneous mixture of solids dispersed in liquid. In accordance with one embodiment of the present invention, coal tar decanter sludge received from the coke oven, including approxiamtely 10 to 50% by weight coal and coke solids, is fed into a sludge mixing vessel where it is deposited onto a liquid-permeable support member or screen having a predetermined maximum screen size. A suitable coal tar solvent or diluent in the sludge mixing vessel is heated to a temperature sufficient to partially solubilize and reduce the viscosity of the coal tar portion of the coal tar decanter sludge to provide a pumpable dispersion of solids dispersed in a diluted coal tar mixture. Agglomerates of coal and coke solids held together with coal tar fall through the screen when sufficient coal tar has solubilized and the solid agglomerates then are reduced in size for recirculation to the sludge mixing vessel.

In accordance with an important feature of the present invention the diluted coal tar mixture is pumped to recirculate it to the sludge mixing vessel after impacting and shearing the solid agglomerates to reduce the solids particle size. To achieve the full advantage of the present invention agglomerates of the diluted coal tar mixture are impacted with a rotating impacting blade or discintegrator to physically break the solid deposits of coal and coke cementaciously held together with coal tar thereby reducing the particle size of the solid agglomerates and to increase the contact area of the solid agglomerates with the diluent.

In accordance with another important feature of the present invention, the solid agglomerates in the diluted coal tar mixture are conveyed through an array of inlet openings of a shear plate and the solid agglomerates in the diluted mixture are is sheared by a rotating impeller blade for further reduction of the particle size of the coal and coke solids tarbound agglomerates. To achieve the full advantage of the present invention, the agglomerates are impacted prior to shearing to achieve sufficient particle size reduction for passage of the remaining agglomerates through the shear plate openings.

Accordingly, an object of the present invention is to provide a new and improved method and apparatus for physically and chemically reducing the particle size of solid agglomerates of coal tar sludge, and particularly coal tar decanter sludge.

Another object of the present invention is to provide a new and improved method and apparatus for fluidizing solid deposits of coal tar sludge and particularly tar decanter sludge to provide a pumpable mixture of solids dispersed in a solvent diluted coal tar mixture.

Still another object of the present invention is to provide a new and improved method and apparatus for fluidizing coal tar sludge agglomerates comprising solid particles of coal and/or coke cementaciously held together with coal tar by contacting the agglomerates of coal, coke and coal tar with a suitable solvent or diluent to partially separate the agglomerates, and physically impacting and shearing the agglomerates to further reduce the agglomerates to a pumpable mixture of solids dispersed in a liquid.

A further object of the present invention is to provide a new and improved method and apparatus for shearing solid coal tar sludge agglomerates into pumpable dispersions.

Another object of the present invention is to provide a new and improved method and apparatus for fluidizing coal tar decanter sludge, mixed with other waste products in a waste storage lagoon, to provide a pumpable mixture of solids and liquid useful as a fuel.

Still another object of the present invention is to provide a new and improved method and apparatus for fluidizing solid agglomerates of coal tar sludge having 5 to 50% and generally 10–50% solid particles of coal and/or coke agglomerated together with coal tar.

The above and other objects and advantages of the present invention will become apparent from the following detailed description of the preferred embodiment described with reference to the drawing.

DETAILED DESCRIPTION OF THE PREFERRED EMBODIMENT

Figure 1:
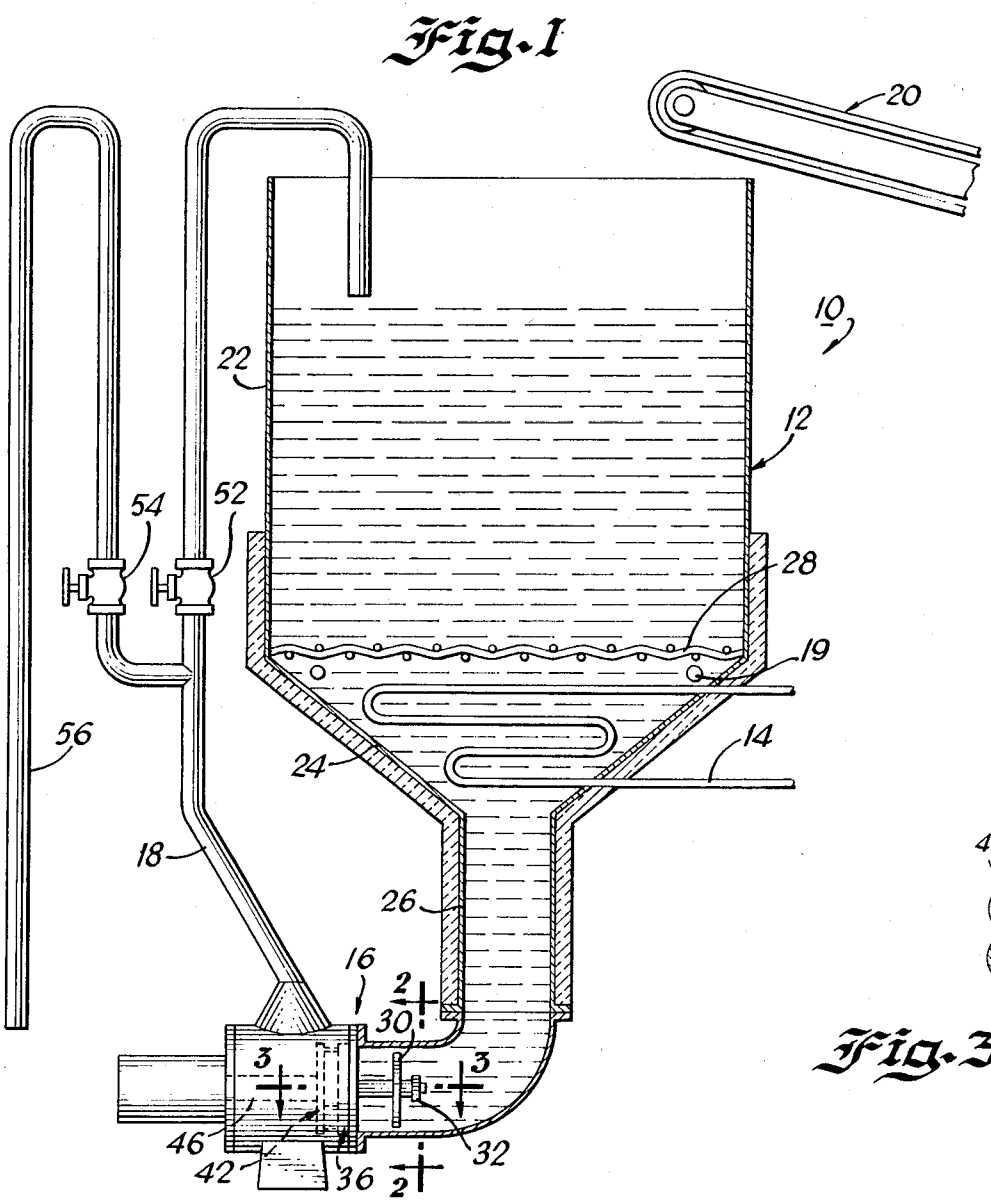
FIG. 1 is a partially elevated cross-sectional view of the apparatus of the present invention.

Turning now to the drawing and, initially to FIG. 1, there is illustrated apparatus of the present invention, generally designated 10, for fluidizing solid agglomerates of coal tar sludge from a coking oven to produce a solvent-diluted pumpable dispersion of coal and/or coke solid particles dispersed in a liquid. The apparatus 10 includes a mixing vessel, generally designated 12, a heating coil 14, a solid-liquid pump, generally designated 16 and a recirculation conduit 18 for recirculating the diluted solid-liquid dispersion back to the mixing vessel 12. An annular air sparger 19 is disposed within the mixing vessel 19 to provide agitation to the liquid and dispersed solids to maintain good liquid-solid contact and provide a relatively homogeneous mixture. It is understood that any form of agitation, such as a mechanical agitation, could be used instead of the air sparger 19. The sparger 19 is generally an annular hollow tube operatively connected to a source of compressed air and includes a plurality of upwardly directed fluid openings (not shown). A suitable conveyor apparatus, generally designated 20, is disposed above the mixing vessel 12 to convey coal tar sludge, particularly a sludge including coal tar decanter sludge received directly from the coking oven, from a tar decanter vessel (not shown) into the mixing vessel 12. It is understood that any means for conveying the coal tar sludge into the mixing vessel 12 can be used in place of the conveyor 20. For example, a skip car mounted on an assembly (not shown) forming a vertical or inclined elevator ramp can be used for dumping the coal tar sludge into the top of the mixing vessel 12.

The mixing vessel 12 includes a generally annular upper portion 22 integral with a generally cone shaped lower portion 24 converging to a sludge mixing tank outlet conduit 26 in fluid communication with the solid-liquid pump 16.

A grate or liquid-porous screen 28 having flow-through passages of a predetermined size (e.g. ½ inch to one inch) is disposed within the annular portion 22 of the mixing vessel 12 for initially receiving and retaining the coal tar decanter sludge conveyed into the mixing vessel 12 from conveyor 20. The grate or screen 28 extends completely across the cross section of the mixing vessel 12 to prevent any solid particles or agglomerates larger than the pore size of the screen or grate 28 from reaching the pump 16.

In accordance with the present invention, coal tar sludge is conveyed into the mixing vessel 12 from conveyor 20 at the same time that a suitable solvent is conveyed into the mixing vessel 12. The solvent collects in the mixing vessel 12 in the lower portion 24 and in the mixing tank outlet conduit 26 and the solvent is heated by the heater 14 to a suitable temperature, e.g. 150°–180° F., lower than the flash temperature of the solvent being used. Any solvent sufficiently volatile to dissolve a portion of the coal tar contained in the coal tar decanter sludge can be used in accordance with the principles of the present invention. One particularly useful solvent is a heavy aromatic naptha refined from crude oils as disclosed in application Ser. No. 582,450, filed Feb. 22, 1984 assigned to MAROC, INC. of Cleveland, Ohio, having the following specifications:

| | |
|---|---|
| API Gravity at 60° F.: | 9 to 13 |
| Flash Point: | about 180° F. |
| Aromatics: | 80 to 100% |
| Initial Boiling Point: | about 400° F. |
| End Boiling Point: | about 570° F. |

This particular solvent has been blended at about 100° F. to 200° F. for reducing the viscosity of liquid coal tars. Other aromatic solvents such as napthas, napthalene and the like, having flash temperatures, for example, in the neighborhood of 150°–250° F. also are useful in accordance with the present invention.

The solvent is added to the coal tar sludge in an amount of about 2–25% by weight or about 5–30% by volume and preferably in an amount of about 10–15 percent by total weight of coal tar sludge and solvent. After heating the solvent to a temperature of about 130°–200° F. while in contact with at least a portion of the coal tar sludge, and preferably in the range of about 150° to 200° F., the hot solvent is recirculated through the mixing tank outlet 26 conduit, pump 16 and conduit 18 to the mixing tank 12. The recirculated hot solvent contacts the coal tar sludge in the mixing tank 12 thereby dissolving a portion of the coal tar and other residues binding the coal and coke solids to permit a portion of the coal tar sludge solid agglomerates to fall through the openings in the grate or screen 28.

The solid agglomerates falling through the screen 28 travel through the lower, cone-shaped portion 24 of the mixing tank 12, through the mixing tank outlet conduit 26 and into the pump 16. The solid particles approaching the pump 16 are agglomerates of coal tar sludge, and, in the case of coal tar decanter sludge, generally include about 10–50% by weight solid particles of coal and coke in the form of fine solid particles bound together cementaciously by coal tar and other residues received directly from the coke oven in the tar decanter vessel (not shown). The agglomerates initially approach the pump 16 having a particle size approximating that of the pore size of the grate or screen 28.

Figure 2:
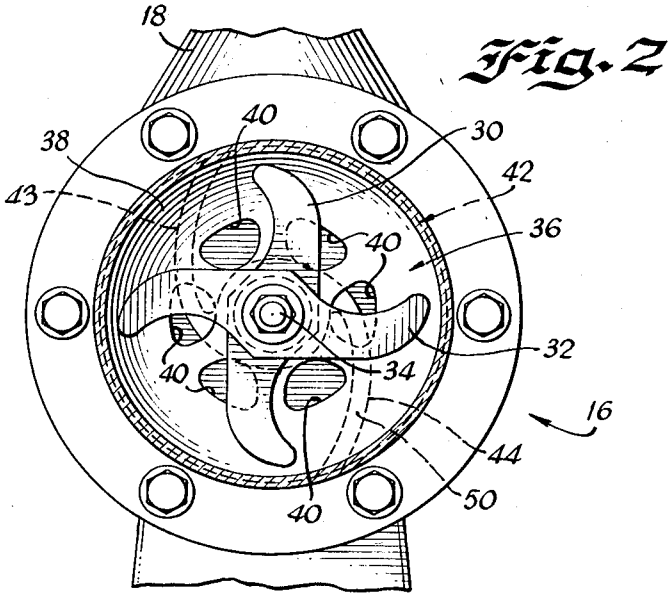
FIG. 2 is a partially broken-away, cross-sectional view showing a pump portion of the apparatus of the present invention taken through the line 2—2 of FIG. 1.
Figure 3:
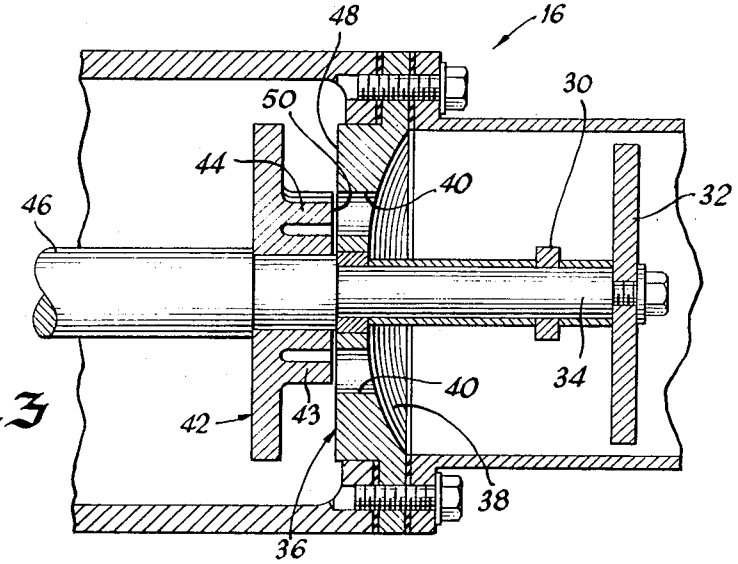
FIG. 3 is a partially broken-away, cross-sectional view of the pump portion of the apparatus of the present invention taken through the line 3—3 of FIG. 1.

In accordance with an important feature of the present invention, the pump 16 (FIGS. 2 and 3) includes a pair of impact members or impact blades 30 and 32 rotatable about shaft 34 in a counterclockwise direction (as shown in FIG. 2) for impacting the solid agglomerates of coal and/or coke solid particles held together with the coal tar to reduce the particle size of the decanter sludge agglomerates. It is understood that the impact blades 30 and 32 need not form part of the pump 16 but can be rotated from a separate motor disposed before or after pump 16 in the recirculation loop formed by mixing tank outlet conduit 26, pump 16 and recirculation conduit 18. To achieve the full advantage of the present invention, the impact blades 30 and 32 are curved radially outwardly in the direction of rotation of the blades 30 and 32, as best shown in FIG. 2.

In accordance with another important feature of the present invention the pump 16 includes a shear plate, generally designated 36, having a concave inlet surface 38, to initially direct the sludge agglomerates from a planar rear surface of the impact blades 30 and 32 into an array of shear plate openings 40 in shear plate 36. In accordance with another important feature of the present invention, the inner impact blade 30 is sufficiently spaced from the concave inlet surface 38 of the shear plate 36 and the inner and outer impact blades 30 and 32 are sufficiently spaced, e.g. at least 3 times the smallest pore or screen size dimension of the screen 28, to prevent agglomerates falling through screen 28 from binding between impact blades 30 and 32 or between the inner impact blade 30 and the concave shear plate inlet surface 38.

In accordance with another important feature of the present invention, an impeller generally designated 42, including two integral, spaced, curved impeller blades 43 and 44 rotatable about shaft 46, is disposed closely adjacent a back surface 48 of shear plate 36 (e.g., 0.005 inch spacing between back surface 48 of shear plate 36 and a front surface 50 of impeller blades 43 and 44). The impeller blades 43 and 44 include planar front and rear major surfaces and shear the solid agglomerates of coal and coke particles bound together with coal tar as the agglomerates exit the openings 40 in the back surface 48 of shear plate 36. The blades 43 and 44 shear the agglomerates and further reduce the agglomerate particle size to form a relatively homogeneous mixture of diluted coal and/or coke solid particles dispersed in diluted coal tar liquid. To achieve the full advantage of the present invention, the impeller blades 43 and 44 each include a planar surface adjacent the back surface 48 of the shear plate 36 and are curved radially outwardly in a direction of rotation of the impeller blades 43 and 44. It is understood that shearing need not occur within the pump 16, but a shear plate operatively associated with one or more impeller blades, as described, can be disposed at any other point in the recirculation loop formed by mixing tank outlet conduit 26, pump 16 and recirculation conduit 18. To achieve the full advantage of the present invention, the impact blades 30 and 32 contact the solid agglomerates prior to shearing.

The apparatus 10 provides recirculation of diluted coal tar and dispersed solids from the mixing tank 12 through the pump 16 and through the recirculating conduit 18 to reduce the particle size of the agglomerates conveyed to the mixing tank 12 until the mixture is sufficiently fluid and homogeneous. To achieve a dispersion suitable for use as a fuel, the dispersed mixture cannot have solid particles greater than ⅛ inch in any dimension so that the dispersion is readily pumpable and sprayable.

Figure 4:
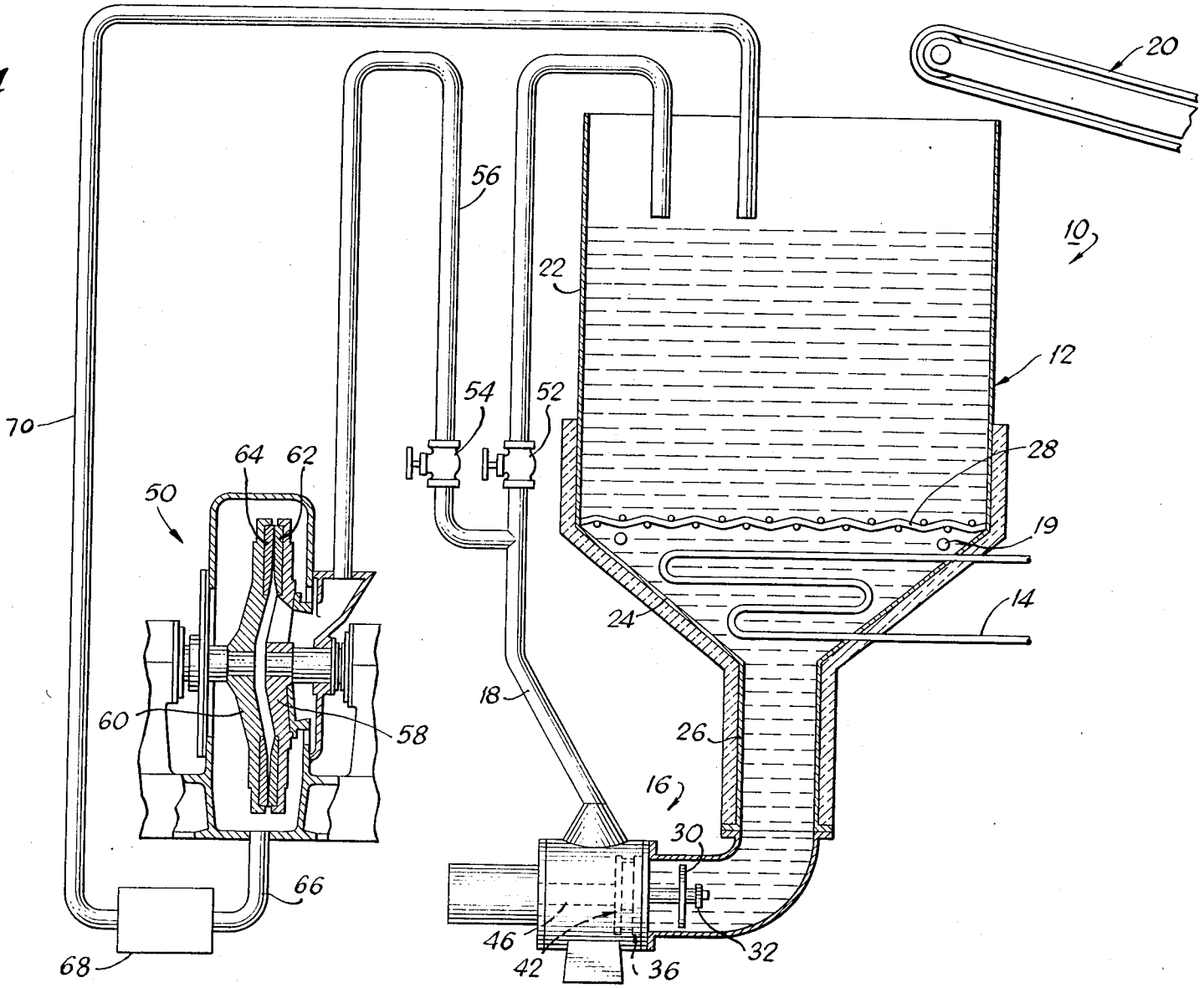
FIG. 4 is a partially elevated, cross-sectional view of an alternate embodiment of the apparatus of the present invention.

In accordance with another embodiment of the present invention, shown in FIG. 4, an attrition mill, generally designated by reference numeral 50 is provided for final particle size reduction of the diluted coal tar mixture. After sufficient treatment of the agglomerates in accordance with the apparatus 10, recirculation conduit valve 52 can be closed and valve 54 opened to feed the relatively homogeneous, diluted mixture through attrition mill feed conduit 56 between attrition mill annular steel plates 58 and 60 having closely spaced annular discs 62 and 64 attached at the radial ends. The attrition mill 50 is capable of further reducing the solids particle size of the diluted mixture after sufficient impacting and shearing as described above. Generally, the particle size of the agglomerates should be reduced, by impact blades 30 and 32 and shearing by impeller 42, to achieve a dispersion having at least 10% by weight of the solid particles less than 150″ in any dimension prior to treatment by attrition mill 50. The diluted coal tar-solids mixture exits the attrition mill 50 at outlet conduit 66 and is pumped by pump 68 through conduit 70 for recirculation to the mixing vessel 12 until a desired maximum solids particle size, e.g., 1/32 inch, is achieved in the homogeneous dispersion. The attrition mill 50 in only used when finer solids are necessary for example, for spraying the dispersion through fine spray nozzles.

The method and apparatus described herein is particularly suitable for fluidizing the many hazardous waste lagoons containing coal tar decanter sludge as well as other wastes, particularly mixtures of tar decanter sludge and other coal tar sludges such as tank sludge. Such waste mixtures sometimes contain only 2–5% coal and/or coke solids at intermediate levels of the lagoon and generally contain 5–40% coal and/or coke and other waste solids near the bottom of the lagoon. The dispersed solids in diluted liquid coal tar is an excellent fuel wherever fuels are used such as in cement kilns, lime plants, large utility plants, and particularly in a steel mill where fuels having a high carbon percentage are valuable such as in a blast furnace, open hearth furnace, steel mill boilers, and soaking pits.

We claim:

1. A method of fluidizing solid agglomerates of coal tar sludge, comprising solid particles of coal and/or coke adhered together with coal tar, into a relatively homogeneous form comprising:

depositing solid agglomerates of coal tar sludge onto a liquid-permeable screen within a sludge mixing vessel;

contacting the coal tar sludge in the mixing vessel with a liquid diluent capable of and in an amount sufficient for fluidizing a portion of the coal tar sludge at elevated temperature reducing the viscosity of the sludge sufficiently to form a diluted coal tar sludge mixture capable of pumping for recirculation;

heating the diluted coal tar sludge mixture to a temperature sufficient to fluidize a portion of the coal tar sludge and to reduce the viscosity of the diluted coal tar sludge mixture to a degree sufficient for recirculation through a pump;

impacting solid agglomerates of the diluted coal tar sludge to physically break agglomerates in the diluted mixture, to reduce the particle size of the agglomerates to a degree sufficient to pass through a pump for recirculation, and to increase the contact area of the solid agglomerages with the liquid diluent;

conveying the diluted coal tar sludge mixture through said pump; and recirculating the diluted mixture from the pump to the sludge mixing vessel.

2. The method of claim 1 including shearing the solid agglomerates.

3. The method of claim 1 including shearing the agglomerates by rotating an impeller blade closely adjacent fluid openings in an outlet side of the pump.

4. The method of claim 1 wherein the fluidized liquid is heated to a temperature of 130° F. to 250° F.

5. The method of claim 3 including impacting the agglomerates by contacting the agglomerates with a rotating impact blade.

6. The method of claim 5 including rotating the impact blade and the impeller blade at the same speed.

7. The method of claim 6 including rotating the impact blade and the impeller blade at a speed of 1100 R.P.M. to 1800 R.P.M.

8. The method of claim 1 wherein the liquid diluent is a naptha derived from refining crude oil.

9. The method of claim 1 wherein the liquid diluent is an aromatic solvent having a flash temperature of 150°-250° F.

10. The method of claim 1 wherein the coal tar sludge comprises tar decanter sludge.

* * * * *

UNITED STATES PATENT AND TRADEMARK OFFICE

CERTIFICATE OF CORRECTION

PATENT NO. : 4,579,563

DATED : April 1, 1986

INVENTOR(S) : Kenneth D. Burnside, et al

It is certified that error appears in the above-identified patent and that said Letters Patent are hereby corrected as shown below:

Col. 8, line 1, "1" should read --2--;

line 4, "fluidized" should read --fluidizing--.

Signed and Sealed this

*Eighth* Day of *July 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. :4,579,563
DATED :April 1, 1986
INVENTOR(S) :Kenneth D. Burnside, et. al.

It is certified that error appears in the above-indentified patent and that said Letters Patent is hereby corrected as shown below:

Column 4, line 36, after "aromatic" delete "naptha" and substitute therefor --naphtha--;
Column 4, lines 49 and 50, after "as" delete "napthas, napthalene" and substitute therefor --naphthas, naphthalene--; and
Column 8, line 15, after "a" delete "naptha" and substitute therefor--naphtha--.

Signed and Sealed this

Fifteenth Day of March, 1994

*Attest:*

Bruce Lehman

BRUCE LEHMAN

*Attesting Officer*

*Commissioner of Patents and Trademarks*